United States Patent [19]

Patton et al.

[11] Patent Number: 4,841,721

[45] Date of Patent: Jun. 27, 1989

[54] VERY HIGH EFFICIENCY HYBRID STEAM/GAS TURBINE POWER PLANT WITH BOTTOMING VAPOR RANKINE CYCLE

[76] Inventors: John T. Patton, 2955 McDowell; Ahmad R. Shouman, 1006 Bloomdale, both of Las Cruces, N. Mex. 88005

[21] Appl. No.: 7,675

[22] Filed: Jan. 28, 1987

Related U.S. Application Data

[63] Continuation-in-part of Ser. No. 701,767, Feb. 14, 1985, abandoned.

[51] Int. Cl.[4] ..... F02C 6/00; F02C 7/00

[52] U.S. Cl. ..... 60/39.05; 60/39.181; 60/39.55

[58] Field of Search ..... 60/39.05, 39.55, 39.181, 60/39.04, 39.5, 39.161, 728

[56] References Cited

U.S. PATENT DOCUMENTS

| | | | |
|---|---|---|---|
| 2,793,497 | 5/1957 | Walter | 60/39.55 |
| 3,783,614 | 1/1974 | Walker | 60/39.181 |
| 3,978,661 | 9/1976 | Cheng | 60/39.55 |
| 4,184,325 | 1/1980 | Mandrin | 60/39.181 |
| 4,571,935 | 2/1986 | Rice | 60/39.05 |
| 4,597,256 | 1/1986 | Hamill et al. | 60/39.05 |

FOREIGN PATENT DOCUMENTS

| | | | |
|---|---|---|---|
| 81104 | 5/1982 | Japan | 60/39.181 |
| 217708 | 12/1983 | Japan | 60/39.55 |

*Primary Examiner*—Donald E. Stout
*Attorney, Agent, or Firm*—Francis J. Lidd

[57] ABSTRACT

An improved thermal efficiency power plant for converting fuel energy to shaft horsepower is described. The conventional combustor of a gas tubine power plant is replaced by a direct contact steam boiler 8, modified to produce a mixture of superheated steam and combustion gases. Combustion takes place preferably at stoichiometric conditions. The maximum thermal efficiency of the disclosed plant is achievable at much higher pressures than conventional gas turbines. Uses of multi-stage compression turbines (4, 9, 1, 10) with intercooling (2, 3) and regeneration (16, 17, 18, 19) is utilized along with a vapor bottoming cycle (11, 12, 13) to achieve a thermal efficiency greater tha 60% with a maximum drive turbine inlet temperature of 1600 degrees Fahrenheit.

8 Claims, 1 Drawing Sheet

VERY HIGH EFFICIENCY HYBRID STEAM/GAS TURBINE POWER PLANT WITH BOTTOMING VAPOR RANKINE CYCLE

CROSS REFERENCE TO RELATED APPLICATIONS

This application is a continuation in part of our application Ser. No. 06/701,767 filed on Feb. 14 1985, now abandoned.

BACKGROUND OF THE INVENTION

It is well known thermodynamically that the Carnot cycle is the yardstick used to compare various practical power cycles. The thermal efficiency of a Carnot cycle is the maximum possible achievable efficiency and is given by $$TE_{Carnot} = 1 - \frac{T\,\text{low}}{T\,\text{high}}$$

where T high is the maximum absolute temperature available for the cycle and T low is the absolute heat sink temperature the cycle rejects heat to. It is obvious that the above expression has been the guide to engineers and technologists striving to improve the thermal efficiencies of practical engines. It is obvious that the higher T high is, the more efficient the Carnot cycle becomes. However, T high is limited by the material used for the construction of any particular engine design. This explains why metallurgists are continuously searching for new materials that can withstand higher and higher temperatures. However, this can distract from finding useful alternative solutions as demonstrated by the teachings of this patent.

The regenerative-reheat steam Rankine cycle is the cycle used for power generation in most larger power plants today. At present the maximum temperature used for this steam power cycle is limited to approximately 1050° F. which produces a maximum achievable thermal efficiency of approximately 40%. On the other hand gas turbine power plants operating on the Brayton cycle as well as large jet engines for aircraft propulsion have a maximum operating temperature in the range of 1600° F. to 2000° F. At 2000° F. blade cooling is necessary. In spite of this high temperature, the thermal efficiency of such a power plant is approximately 28% which is considerably less than that of the steam power plant operating at 1050° F. Of course, the most attractive characteristic of a jet engine for aircraft application is the power produced per unit weight of the power plant. However, once these power plants were developed, they were adapted for electric power generation use.

Early Brayton cycle gas turbine applications were used for peak electrical loads since they can be brought on line quickly and since their capital investment is low, thus compensating for the fuel expenses. In theory, applying regeneration to the Brayton cycle improves thermal efficiency. However, this efficiency improvement occurs at much lower turbine pressure ratios than that of the non-regeneration case. Even when an engine is designed with regeneration in mind, the low cycle pressure ratio makes it vulnerable to the effect of pressure losses in the various components and increases the components' size for any desired power output, thus increasing the capital cost of the plant.

With the availability of high operating temperature turbine technology, a logical question arises. Why not upgrade the steam power plants by raising their maximum operating temperature to 1600° F. This would significantly raise their thermal efficiency. This also would not be unusual for the power industry since power plants in the past has been upgraded by raising both operating pressures and temperatures. However, with little investigation, it becomes clear that the steam producing boiler is the limiting component. Using carbon steel for the construction of the boiler limits the maximum steam temperature to about 1100° F. To achieve higher temperature like 1600° F. would require much more expensive material for the construction of the conventional boiler thus making it economically prohibitive.

Prior applications of gas turbines operating with steam injection are disclosed in U.S. Pat. No. 3,693,347 (Kydd and Day), U.S. Pat. No. 2,678,531 (Miller) and U.S. Pat. No. 3,353,360 (Gorzegno).

These systems indicate that it is well known that operation of gas turbine in the steam injection mode provides greater power output and produces improvements in thermal efficiency in the overall system.

In U.S. Pat. No. 3,978,661, Cheng teaches combining the gas turbine and the Rankine cycle steam turbine into a single operating turbine, thus raising the operating pressure of a Brayton cycle which is higher than the operating pressure of conventional Brayton cycle gas turbines. Cheng further teaches the use of a direct fired steam generator of the type disclosed in U.S. Pat. No. 4,490,542 (Eisenhawer) to inject steam and combustion products into the first stage of a conventional Brayton Cycle gas turbine.

However, an integral part of the Cheng patent, is the use of a waste heat boiler to produce steam by recovering part of the available heat energy in the exhaust gases. The steam produced is injected in the combustion chamber of the machine. By virtue of lowering the exhaust gas temperature, the Cheng machine achieves higher efficiency than conventional gas turbines.

When recovering heat as taught by Cheng, in the regenerative Rankine mode when the turbine exhaust temperatures are high, as required to achieve maximum internal efficiency, a heat recovery limitation exists. In this situation, the conventional heat recovery boiler operates at greatly reduced efficiency, since the recovery liquid approaches and exceeds it's saturation temperature and pressure causing the temperature differential between the exhaust gases and the recovery liquid to be minimized. This particular combination of exhaust gas temperature, and heat recovery liquid saturation temperature is known as the "pinch point".

The phenomenon of the "pinch point" limits the maximum achievable boiler pressure and the minimum achievable exhaust gas temperature putting a limit to the possible improvement in efficiency. Hence, Cheng does not solve the effect of "pinch point" limitation on maximum achievable thermal efficiency, since heat recovery is limited by exhaust gas temperature.

A combined Brayton-Rankine cycle power plant operating according to the Cheng patent is therefore limited in thermal efficiency by the "pinch point" phenomenon. This phenomenon further limits the maximum achievable pressure in the exhaust heat recovery boiler. It also limits the cooling of the exhaust gases to a relatively high temperature. The particular combination of low maximum boiler pressure and high exhaust temperature limits the maximum achievable thermal efficiency.

A system enclosed disclosed by Cheng shows a maximum achievable efficiency of 50% at a maximum turbine inlet temperature of 2200 degrees Fahrenheit. These high turbine inlet temperatures impose an additional limitation in that conventional technology limits turbine blade operating temperatures to approximately 1600 degrees Fahrenheit. Therefore, Cheng finds it necessary to utilize transpirational cooling of at least the first portion of the turbine inlet blades. As it is well known in the art that transpirational cooling is an expensive and sometimes unreliable process, the limitations is substantial and includes increased cost of a given installation.

The heat engine following the concepts of this invention utilize a direct fired high pressure steam generator and produces maximum efficiency at a much higher pressure ratio than conventional gas turbines. Because of the high pressure ratio it is necessary to use multi stage expansion and compression turbines. The water supply to the direct contact boiler is used to inter-cool the air between compressor stages. Also, as indicated above, thermal regeneration is utilized to improve the thermal efficiency of the power plant. Also, due to the presence of non-condensible gases in the exhaust of the turbine it is advantageous to condense steam in the driven turbine exhaust products at pressures above atmospheric thereby avoiding the use of an evacuator.

In keeping with the above described invention disclosed here, steam is condensed using a suitable secondary fluid such as Freon 11 in a bottoming Rankine cycle thus maximizing the power plant thermal efficiency. Through utilization of conventional heat recovery in regeneration, and a bottoming cycle in conjunction with the direct contact steam generator or boiler, the power output per unit weight or unit volume of plant is much higher than known power plants at this time.

It is therefore the object of this invention to provide an operating power plant having increased thermal efficiency while utilizing present day gas turbine technology while operating within maximum allowable turbine temperatures.

It is an additional object of this invention to replace the conventional combustion chamber of a gas turbine power plant and the conventional boiler of a Rankine cycle power plant by an inexpensive direct contact steam boiler or generator wherein a mixture of superheated steam and combustion gases is injected as the turbine operating fluid.

It is an additional object of this invention to burn a stoichiometric mixture of fuel-oxidizer in the direct contact boiler and to control maximum generator discharge temperature by controlling generator feed water input in relation to the combustion fuel and air.

It is yet an additional object of this invention to reduce the NO x pollutants by burning a stoichiometric mixture at substantially lower temperature than conventional direct fired generators.

It is further object of this invention to provide a steam injected Brayton cycle power plant wherein drive turbine blades do not require transpirational cooling.

It is a further object of this invention to provide a high efficiency steam injected Brayton cycle power plant where overall efficiency is greatly improved by heat recovery or regeneration wherein the thermal "pinch point" limitation is eliminated.

BRIEF DESCRIPTION OF THE INVENTION

A particularly unique thermal advantage provided by the invention disclosed herein is the utilization of a bottoming Rankine cycle, utilizing intercoolers and regenerative feedwater heaters in place of heat recovery boilers to recover heat from the drive turbine exhaust. The disclosed heat recovery system overcomes the above mentioned "pinch point" limitations present in prior art systems, as will be further discussed in detail.

As indicated above, to achieve the best possible thermal efficiency operation of any thermodynamic system the highest possible temperature ratio is desirable. In the invention disclosed herein, the use of the direct fired steam generator provides substantially increased temperatures with attendant pressures at the drive turbine inlet. In order to maximize overall system efficiency, recovery of heat from the turbine discharge is absolutely necessary. This technique is termed the regenerative Rankine or Brayton cycle. However, heat recovery of regenerative Brayton type is a maximum at a pressure ratio of about 4:1 for present day operating temperatures. The system disclosed herein operates at an overall compression ratio greater than 200 making the system substantially less vulnerable to pressure losses and reduced power output. Typically, operation at maximum pressures of 200 atmospheres can be achieved.

The system disclosed herein provides substantially increased efficiency without the use of heat recovery boilers and thus avoids the "pinch point" phenomenon through the use of the above mentioned bottoming cycle, intercoolers, and regenerative heat water heaters. This combination greatly improves the Brayton cycle through the use of a high temperature, high pressure direct fired steam generator but does not suffer a loss of efficiency in recovering heat from the drive turbine exhaust although these temperatures and pressures fall within the "pinch point" region.

BRIEF DESCRIPTION OF DRAWINGS

Other objects and advantages of the invention will become apparent upon reading the following detailed description of and upon reference to the drawings in which.

DESCRIPTION OF THE PREFERRED EMBODIMENT

Figure 1:
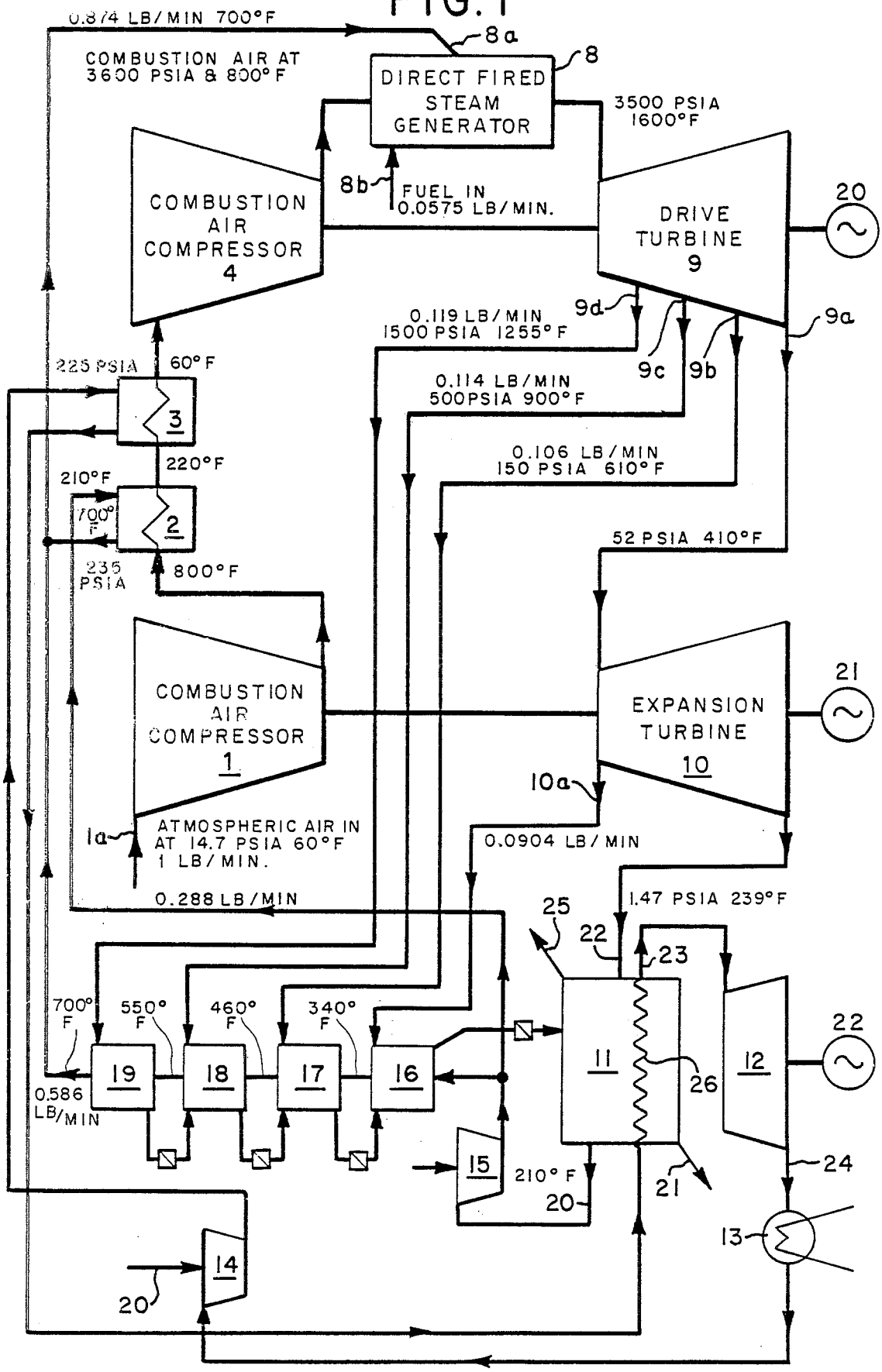
FIG. 1 is a semi-schematic block diagram of a preferred embodiment i.e., a power plant incorporating principles of the disclosed invention typical but not limiting temperatures, pressures, flow and heat rates are shown.

The basic cycle is diagrammed in FIG. 2. The unit can be of any size. Other arrangments can be chosen to give optimum operating conditions according to the desired application. We shall use as an operating example the power plant having parameters shown as Example 1 where the detailed flow rates and thermodynamic properties given. The maximum temperature is chosen as 1600° F. in order to utilize state of the art gas turbine technology. Example 1 is a specification sheet and description of a power plant constructed according to the principles of the invention, particularly showing typical performance data of various components such as fluid pressures, temperatures and flow rates.

With particular reference to FIG. 1, there is shown a turbine driven power plant suitable for driving an electric generator or providing shaft horsepower for other requirements. As disclosed, the system utilizes a main drive turbine 9 providing shaft horsepower to a load 20, typically a dynamo electric generator. An axial or centrifugal compressor 4 is mechanically coupled to the drive turbine 9 for delivering combustion air at pressures and temperatures in the range of 1500–3000 PSIG and 700° F., to a direct fired steam generator 8 of the type disclosed in U.S. Pat. No. 4,490,542. The steam generator is also supplied with feedwater at a temperature in the range of 700° F. at 8A, and fuel at its inlet 8B. Combustion air and fuel are contacted within the generator such that combustion is essentially complete prior to the injection of the feedwater.

As shown, the direct fired steam generator ouput consisting of steam and combustion products enter the drive turbine 9 at pressures in the pressure and temperature ranges of 3500 lbs. per square inch and 1600° F. respectively. Drive turbine 9 is of the axially stages type having a plurality of operating fluid discharges at 9*a*, 9*b*, 9*c* and 9*d*. The function and use of these discharges will be fully developed below.

An additional and auxiliary compressor/turbine is comprised of expansion turbine 10 operating from drive turbine exhaust 9*a*. A steam generator combustion air compressor 1 is mechanically coupled to the expansion turbine 10 for raising atmospheric inlet air entering the turbine at 1*a* thereby providing combustion air temperatures and pressures in the range of 800° F. and 235 PSIA as a pressure boosted supply at the inlet of feedwater and Freon heat recovery exchangers 2, and 3 respectively. Combustion air cooled to 60° F. and 225 PSIA, exiting exchanger 3, enter the low pressure inlet of compressor 4. The high pressure output of compressor 4 supplies combustion air to the direct fired generator 8 at inlet 8*c*.

In keeping with a major concept of the invention disclosed here, i.e., a Freon bottoming cycle which will be discussed in detail below, including Freon heat exchanger 3, is utilized to cool exit air from first stage combustion air compressor 1 thus reducing the power requirement of the combustion air compressor 4. Typically, as shown, inlet air to the combustion air compressor 4 is cooled from 220° F. to 60° F. at the inlet of compressor 4. Similarly, a feedwater heater 2 is also utilized to cool the combustion air delivered to combustion air compressor 4 as shown on FIG. 1.

With further reference to the above mentioned Freon bottoming cycle, the expansion turbine 10 operating from exhaust tap 9*a* of the drive turbine 9, separates the exhaust products into noncondensing gases exiting at 25, with water vapor, from direct fired steam generator exhaust exiting at outlet 22. The bottoming cycle Freon boiler and exhaust condenser 11 is supplied from expansion turbine 10, at its exit 22, wherein heat is extracted from a Freon boiler or heat exchanger 26 for driving the Freon expansion turbine 12. Expansion turbine 12 therefore, operates from Freon vapor exiting the Freon boiler at 23, typically at temperatures in the range of 238° F.

The Freon expansion turbine 12 can be used to drive an auxiliary generator or provide other shaft horsepower as shown at 22. Freon vapors exiting the expansion turbine 12 at 24 are condensed to liquid Freon in the Freon condenser 13 and enter Freon pump 14 driven by an external source of energy 20 for delivery to a Freon/combustion air cooler 3, for further decreasing the power requirement of the combustion air compressor 4.

The use of more than one compressor for supplying combustion air is a necessary teaching of the invention disclosed for the following reason; Since the optimum pressure ratio of this cycle is quite high, if only one compressor is used, the temperature of the air leaving the compressor could be higher than the maximum cycle temperature. This would be undesirable from the point of view of the cycle efficiency as well as the blade material of the compressor. However, the optimum number of compressors and their individual pressure ratio is dependent on the power plant design and those knowledgeable in the art would have no difficulty in making the choice.

The amount of fuel and air supplied to the boiler 8 is regulated in such a manner that the temperature leaving the direct contact boiler 8 is the maximum temperature desired for the operation of the power plant. The direct contact boiler could be designed in two stages if necessary.

The hot Vapor and combustion gases leaving the direct contact boiler 8 expand through turbine 9 adiabatically. In this particular embodiment the turbine 9 drives compressor 4 as well as a load 20. Also the turbine 9 has three bleed points that supply hot gases to the three regenerative heat exchangers 17, 18 and 19 as discussed above. Typically, in keeping with Applicant's invention, feedwater temperatures and exchangers 16, 17, 18 and 19 are limited to saturation values at specific pressures of their inputs from the respective drive turbine discharge outlets 9*a*, 9*b*, 9*c*, and 9*d* respectively. Under these operating conditions of pressure and temperature, the temperature difference between drive turbine exhaust products and feedwater undergoing heating is maximized, thereby avoiding the "pinch point" limitation found in prior art regenerative heat recovery as discussed above (Reference FIG. 1, and FIG. 2-paragraph 5).

The drive turbine exhaust gases leaving the turbine 9, at 9*a* expand adiabatically through the turbine 10 which drive the compressor 1 and the load 21. The turbine 10 has one bleed point, 10*a*, supplying hot gases to the regenerative heat exchanger 16 for heating feedwater and Freon in exchangers 16 and 26 respectively. The number of turbines and their arrangement in this embodiment is not a critical part of the invention disclosed as indicated above. Other arrangements could be more efficient or desirable depending on the power plant and specific application or use.

Exhaust gases leaving the turbine 10 enter the boiler condenser 11. Freon 11 cools the exhaust gates in the boiler condenser 11 thus condensing most of the water present. The non-condensable gases are discharged to the atmosphere through outlet 25 and the excess water resulting from the combustion of the fuel, through outlet 21. The feed water leaving the boiler condenser 11 via outlet 20 is pumped by pump 15 as described above, through the various regenerative heaters and the compressor intercoolers and returned to the direct contact steam generator 8.

Vaporized Freon 11 leaving the boiler condenser 11 at point 23, expands adiabatically through the turbine 12 which drives an auxiliary load 22. The Freon 24 leaving the turbine 12 is condensed in a condenser 13 and then pumped by pump 14 through the compressor intercooler 3 and then returned to condenser and Freon boiler 11. The bottoming cycle characteristics as utilized in this invention used Freon 11 or any suitable fluid is a necessary condition for the operation of the power plant at greatly increased efficiencies.

As indicated by Example 1, the preferred embodiment of the invention disclosed provides a means for increasing the efficiency of a Brayton cycle turbine through increased high-pressure injection of steam and combustion products as discharged from a direct fired steam generator of known design. The system disclosed provides both high pressure combustion air from compressors 1 and 4, and feedwater from pump is for the high pressure steam generating system.

This application of the direct fired steam generator, in addition to improving the Grayton cycle efficiency, allows the use of high pressure combustion techniques developed elsewhere to produce a small lightweight highly reliable power generating system wherein the turbine inlet temperature and pressure can be readily controlled through control of the direct fired steam generator discharge.

As indicated by Example 1, overall turbine compression ratios of the system disclosed in approximately 200, while the gas turbine inlet temperatures do not exceed 1600 degrees Fahrenheit. It should be noted, present turbine technology provides at moderate cost the equipment which reliably operates at the 1600 degree figure.

EXAMPLE 1

1. Two stage compressors (i.e., #1 and #10; #4 and #9) with a pressure ratio of 16:1 each.
2. A direct fired steam generator (DFSG) #8 operating with stoichiometic air-fuel ratio and using fuel with lower heating value of 19300 BTU/LB.
3. Two inter-stage air coolers (i.e., #2, and #3).
4. Four regenerative heat exchangers (16, 17, 18, and 19).
5. A bottoming Freon-11 Rankine cycle (11, 12, and 13).
6. Atmospheric pressure is 14.7 psia at 60° F.
7. Heat rejection temperature is 60° F.
8. Compressor efficiency of 85% and turbine efficiency of 90%.
9. Feedwater supplied to the direct contact boiler (#8) at 700° F.

Considering a flow of air of 1 lb/sec, the following calculations are determined:

1. The air leaves the first stage compressor 1 at 235 psia and 800° F. The power requirement of this compressor stage is 254 hp/lb air/sec.
2. The air is cooled to 60° F. after passing through two heat exchangers (2, 3), one using water and the second using Freon-11 as heat exchange medium. A 10 psia pressure loss in the two exchangers is considered.
3. The air leaves the second stage compressor 4 at 3600 psia and 800° F. The power requirement of this second stage compressor is 254 hp/lb air/sec.
4. Fuel supplied to direct contact boiler 8 is 0.0575 lb/lb air/sec and the water supplied is 0.874 lb/lb air/-sec at 700° F. Total heat input rate is 1110 Btu/Sec.
5. The steam-gases mixture leaves the direct contact boiler 8 at 1600° F. and 3500 psia where it enters the first stage turbine 9. A 100 psia pressure loss in the boiler is allowed. The various amount of bleed gases for the heaters are shown in FIG. 1. The gases leave the second stage expansion turbine at 10*a* at 16.7 psia and 238° F. The two stage turbines 9 and 10 produce 1266 hp/lb air/sec. The various coupling of turbines (9, 10, and 12) and compressors (1 and 4) for driving purpose are optional.
6. Heat exchange in Freon boiler steam condenser (11) is 574 Btu/sec.
7. Power output of Freon turbine (12) is 144 hp/lb air/sec.
8. Heat rejected in Freon condenser (13) is 476 But/-sec. This engine has a thermal efficiency of 57% and net power output of 902 hp/lb air/sec.
9. Overall cycle efficiency is 57% at 1600° F. (maximum) generator discharge.

Thus in consideration of the above disclosure it is apparent that there has been provided in accordance with the invention disclosed, a steam injected turbine powered generating system incorporating a high pressure direct fired steam generator providing improved efficiency and operating within temperature limits of available technology. The system disclosed, therefore, fully satisfies the objects aims and advantages set forth above. While the steam injected turbine system has been described here in conjunction with a specific embodiment thereof, it is evident that many alternatives modifications and variations will be apparent to those skillful in the art when viewed in the light of the foregoing description. Accordingly, it is intended to embrace any and all such alternatives, modification and variations as fall within the spirit and broad scope of the appended claim.

Therefore, we claim:

1. In a hybrid steam/gas turbine power plant of the type utilizing a direct fired steam generator supplying high pressure steam and combustion products at an outlet for operating a drive turbine, the improvement comprising:

a direct fired steam generator having fuel, combustion air, and feed water inlets, and an outlet delivering combined steam and combustion gases as high pressure and temperature exhaust products;

a drive turbine having an inlet and outlet, a fluid operated drive stage and a shaft coupled second compressor stage said compressor stage having an air inlet and an air outlet for supplying pressured combustion air to said generator;

a first compressor having an air inlet and outlet, said outlet supplying pressurized combustion air to said second compressor inlet;

means flow communicating said generator exhaust products to said turbine inlet for operating said drive stage;

means in said drive turbine, extracting a plurality of turbine drive stage fluid discharge products at a plurality of first temperatures and pressures, respectively;

means fluid communicating said drive turbine fluid discharge products to a plurality of predetermined locations;

first heat exchange means in at least one of said locations having a drive turbine discharge product inlet and an outlet, a cooling fluid inlet and outlet, and fluid impermeable means therebetween; and, means supplying steam generator feedwater as cooling fluid to said first heat exchanger inlet, said cooling fluid inflow and outflow having second and third inlet and outlet temperatures respectively, and means limiting cooling fluid outflow at said third temperature and pressure corresponding to fluid saturation at said first drive turbine fluid discharge first temperature and pressure temperature;

second heat exchange means intermediate said first compressor and second compressor means, for cooling said generator combustion air having an air inlet and outlet, said air inlet in fluid communication with said first compressor air outlet, a fluid inlet and outlet and fluid isolating means therebetween;

means supplying said feedwater as cooling fluid to said second exchanger fluid inlet, for reducing said generator combustion air temperature thereby increasing generator exhaust product at increased pressure and temperature;

whereby said generator exhaust product is increased and cooling fluid temperature does not exceed saturation providing turbine operation at increased efficiency.

2. The power plant of claim 1 further comprising:

means controlling said cooling fluid flow through said first heat exchange means;

a first fluid expansion turbine for extracting shaft work from said turbine discharge fluids;

a fluid inlet and separate liquid and vapor outlets on said expansion turbine;

means admitting at least one of said drive turbine discharge means to said expansion turbine inlet;

means admitting said expansion turbine liquid exhaust to said first heat exchanger turbine discharge inlet; and a tertiary fluid loop thermally coupled to said cooling fluid, said tertiary loop fluid operating at a saturation temperature and pressure substantially lower than that of said cooling liquid;

wherein heat recovered from said drive turbine exhaust liquid is transferred to said liquid cooling loop at temperatures below saturation of said tertiary liquid.

3. The power plant of claim 2 further comprising;

means condensing said first expansion turbine vapor exhaust having tertiary fluid and drive turbine inlets and outlets, thereby recovering vapor exhaust heat and generator feedwater;

means, in said condensing means, transferring said vapor exhaust heat to said tertiary fluid, said exhaust heat generating tertiary fluid vapor at a fourth temperature and pressure.

4. The power plant of claim 3 further comprising:

a second combustion air compressor shaft coupled to said first fluid expansion turbine said compressor having an atmospheric air inlet and an outlet;

a second fluid expansion turbine, for extracting shaft work from said tertiary fluid vapor;

means on said second expansion turbine admitting said tertiary fluid at said fourth temperature and pressure and discharging tertiary fluid and vapor at a fifth temperature and pressure;

a second heat exhanger intermediate said second combustion air compressor outlet and first combustion air compressor inlet, having a combustion air inlet and outlet tertiary fluid and vapor inlet and outlet and fluid isolating means therebetween;

means fluid communicating said heat exchanger air inlet and second compressor air inlet;

means fluid communicating said heat exchanger air outlet and first compressor air inlet;

means fluid communicating said second expansion turbine discharge and second heat exchanger tertiary fluid/vapor inlet;

means fluid communicating said exchanger tertiary fluid outlet and condensing means heat transferring means;

whereby said tertiary fluid recovers first expansion turbine exhaust heat at temperatures below said turbine exhaust.

5. A method extending the life of a turbine utilized in a hybrid steam/gas turbine power plant of the type utilizing a direct fired steam generator for supplying steam and combustion products to the inlet of a drive turbine having a shaft coupled compressor stage comprising the steps of:

Operating a direct fired steam generator having feedwater, combustion air and fuel inlets, and an outlet delivering exhaust steam and combustion products for operating a drive turbine at a predetermined pressure;

Providing a plurality of pressure and temperature staged exhaust discharges in said drive turbine;

transferring heat, from said turbine exhausts to said generator feedwater; thereby heating said feedwater;

limiting said feedwater heating to saturation temperatures and pressures of said feedwater;

compressing atmospheric air in said compressor to a predetermined pressure and temperature for use as generator combustion air;

supplying said combustion air, feedwater, and fuel to said generator inlets;

cooling said combustion air by transferring heat to said steam generator feedwater;

establishing a combination of said steam generator fuel, feedwater and combustion air flows such that said steam generator exhaust temperatures and pressure does not exceed a predetermined value.

6. The method of claim 5 wherein said establishing step includes the step of limiting the steam generator exhaust to a critical value of 1600° F.

7. The method of claim 6 wherein said establishing step includes the step of limiting the steam generator exhaust pressure to a critical value of 3000 lbs. per square inch.

8. The method of claim 6 further comprising the steps of:

operating a first expansion turbine from at least one of said drive turbine discharges;

establishing a fluid discharge in said expansion turbine;

condensing said discharged fluid thereby generating heat and condensed generator feedwater;

establishing a tertiary fluid heat exchange loop, said tertiary fluid having saturation temperature and pressure substantially less than said expansion turbine discharge;

transferring said condensed feedwater heat to said tertiary fluid, thereby generating tertiary fluid vapor;

driving a second expansion turbine with said tertiary vapor, thereby generating shaft work.

* * * * *